US012435476B2

(12) United States Patent
Powell et al.

(10) Patent No.: US 12,435,476 B2
(45) Date of Patent: Oct. 7, 2025

(54) HIGH-FRICTION ROAD PATCH

(71) Applicant: AUBURN UNIVERSITY, Auburn, AL (US)

(72) Inventors: Raymond L. Powell, Auburn, AL (US); Jason Nelson, Auburn, AL (US)

(73) Assignee: Auburn University, Auburn, AL (US)

( * ) Notice: Subject to any disclaimer, the term of this patent is extended or adjusted under 35 U.S.C. 154(b) by 994 days.

(21) Appl. No.: 17/484,892

(22) Filed: Sep. 24, 2021

(65) Prior Publication Data

US 2022/0098801 A1 Mar. 31, 2022

Related U.S. Application Data

(60) Provisional application No. 63/213,070, filed on Jun. 21, 2021, provisional application No. 63/083,312, filed on Sep. 25, 2020.

(51) Int. Cl.

| | |
|---|---|
| ***E01C 11/24*** | (2006.01) |
| ***E01C 5/08*** | (2006.01) |
| ***E01C 5/12*** | (2006.01) |

(52) U.S. Cl.

CPC ..... *E01C 11/24* (2013.01); *E01C 5/085* (2013.01); *E01C 5/12* (2013.01); *E01C 2201/167* (2013.01)

(58) Field of Classification Search

CPC . E01C 11/24; E01C 5/085; E01C 5/12; E01C 2201/167

See application file for complete search history.

(56) References Cited

U.S. PATENT DOCUMENTS 3,915,582 A * 10/1975 Clarke ..... E01C 23/0926 404/34
3,930,100 A * 12/1975 McDonald ..... E01C 7/265 428/338
4,072,435 A 2/1978 Coho et al.
4,118,137 A * 10/1978 LaGrone ..... E01C 7/265 404/31
4,684,288 A * 8/1987 Chapa ..... E01C 11/005 404/82
5,092,706 A * 3/1992 Bowen ..... E01C 23/06 404/31
5,183,353 A * 2/1993 Buckelew ..... E01C 11/005 404/69
5,447,387 A 9/1995 Fagan
(Continued)

OTHER PUBLICATIONS

Extended European Search Report for European Patent Application No. 21873554.6 dated Sep. 24, 2024, citing U.S. Pat. No. 9,739,017 and U.S. Pat. No. 8,858,115, previously cited in the IDS filed Jan. 25, 2022.

*Primary Examiner* — Abigail A Risic

(74) *Attorney, Agent, or Firm* — Ryan J. Letson; Stephen H. Hall; Bradley Arant Boult Cummings LLP

(57) ABSTRACT

A high-friction road patch may comprise an aggregate capable of providing sufficient friction between a road surface and vehicle wheel. In some embodiments, the patch may comprise a waterproof, asphalt overlay with a first layer of cured bitumen and calcined bauxite aggregate particles, a second layer of viscous bitumen and a reinforcement component, and a binder layer for bonding the overlay with the road surface. The resulting product may provide a sufficient skid resistance value in an overlay that is far less susceptible to or incapable of debonding as with prior art solutions.

20 Claims, 15 Drawing Sheets

(56) References Cited

U.S. PATENT DOCUMENTS

| | | | | |
|---|---|---|---|---|
| 5,660,498 | A * | 8/1997 | Freeman | E01C 11/005 404/82 |
| 7,232,276 | B2 | 6/2007 | Oka et al. | |
| 7,753,616 | B2 | 7/2010 | Greer et al. | |
| 8,534,954 | B2 | 9/2013 | Geary | |
| 8,858,115 | B2 | 10/2014 | Geary | |
| 8,926,742 | B2 | 1/2015 | Coe | |
| 9,739,017 | B2 | 8/2017 | Friel | |
| 9,850,625 | B2 | 12/2017 | Bower et al. | |
| 11,542,667 | B1 * | 1/2023 | Ayadat | B32B 27/065 |
| 2014/0241801 | A1 * | 8/2014 | Eliot | E01C 11/005 404/95 |
| 2017/0067214 | A1 * | 3/2017 | Harrison, Jr. | E01C 19/2025 |
| 2017/0167085 | A1 * | 6/2017 | Li | E01C 11/005 |
| 2017/0306576 | A1 | 10/2017 | Greer et al. | |
| 2021/0024417 | A1 * | 1/2021 | Thompson | C04B 26/04 |

* cited by examiner

HIGH-FRICTION ROAD PATCH

CROSS REFERENCE TO RELATED APPLICATIONS

This application claims priority to U.S. Provisional Patent Application No. 63/083,312, entitled "High Friction Surface Membrane (HFSM)" and filed on Sep. 25, 2020. This application also claims priority to U.S. Provisional Patent Application No. 63/213,070, entitled "High-Friction Road Patch" and filed on Jun. 21, 2021. Each of the foregoing is incorporated by reference herein in its entirety.

BACKGROUND

Field

The present disclosure relates generally to roadway safety and accident reduction techniques, and specifically a high-friction road patch for use therewith.

Background

Friction is an important component of safe operation of automobiles on roadway surfaces. There must be sufficient friction between a vehicle's wheels and road surfacing to allow a user to operate the vehicle safely and effectively. Roadway surfaces sometimes degrade over time, resulting in loss of friction between vehicles and the roadway surface. This loss of frictions can lead to increased accident rates, especially in areas with sharp turns or short stopping distances.

The single previously accepted solution to this problem is a product know as High Friction Surface Treatment (HFST). Installation of HFST involves selecting a day when a pavement is completely dry (i.e., no rain for several preceding days), closing a lane, mixing resin, spreading resin at a specified rate/thickness, spreading high friction particles/grit (typically 100 percent "6×16" calcined bauxite) at a relatively heavy rate, allowing the product to cure (typically overnight) while the lane remains closed, brooming off excess grit (which can be substantial because of the heavy rate) onto the shoulder with a power broom, and opening the lane to traffic. Additional details are described in U.S. Pat. No. 9,739,017 to Friel, filed May 20, 2016 and entitled "High Friction Surface Coating and Method of Making Thereof", which is incorporated herein by reference in its entirety.

Disadvantages of the previous solution include longer exposure to road hazards (from adjacent lane that is supporting live traffic) with larger crew, the necessity of completely dry pavement (which limits installation windows), requirement for a full overnight lane closure, the need for mixing hazardous chemicals (typically epoxy resin, bitumen extended epoxy resin, polyester resin, polyurethane resin, acrylic resin, or methyl methacrylate), labor to spread resin, wasteful application of expensive high friction particles (typically calcined bauxite) necessary to achieve the proper level of embedment, road closure for extended periods of time, need for mechanical power broom to remove excess grit, and the safety hazard the occurs when enough high friction particles have debonded from the age hardened epoxy resin that surface friction is reduced to an unsafe level.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

A. Definitions

Figure 1:
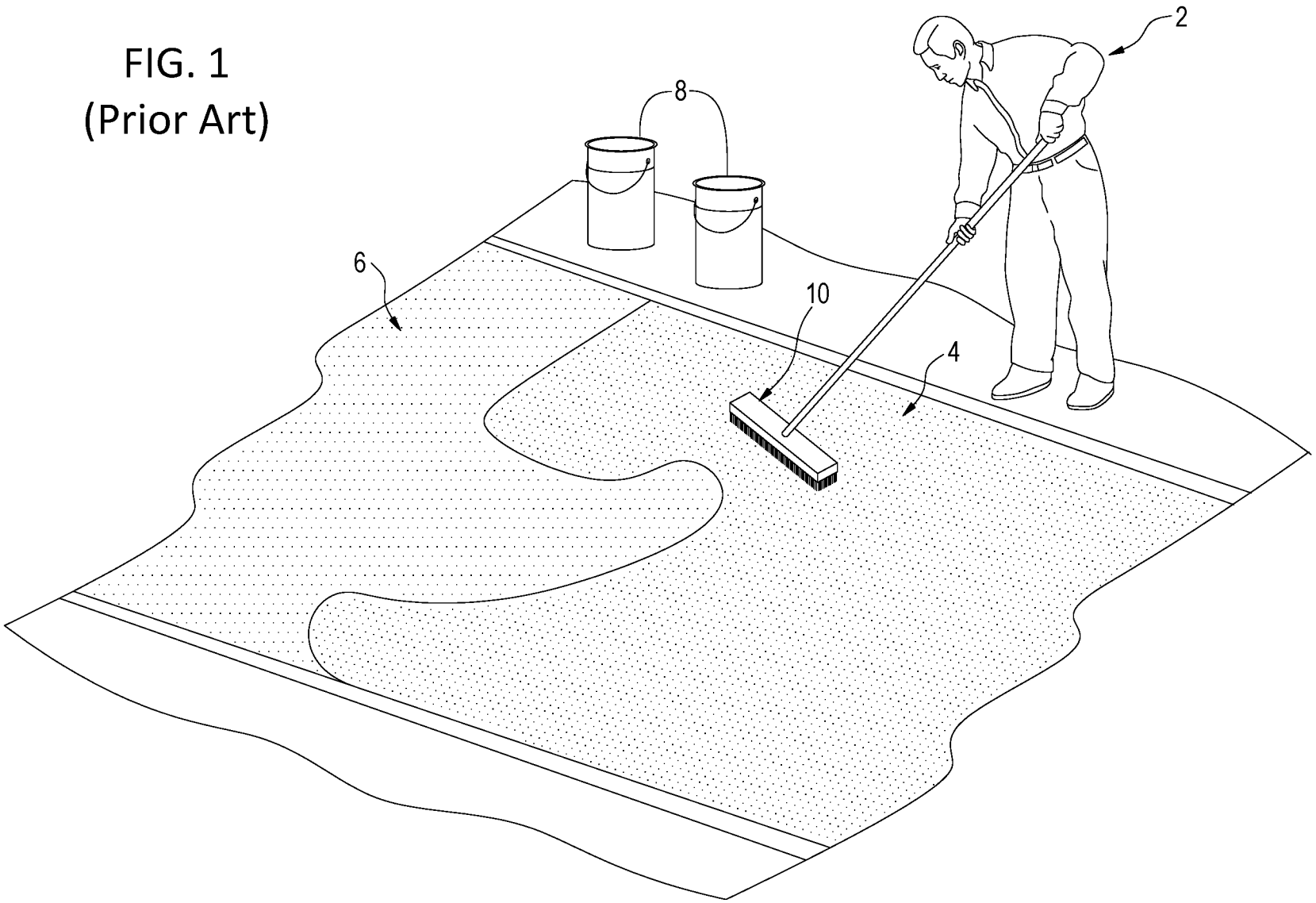
FIG. 1 (Prior Art)
FIG. 1 is a perspective view of application of a resin base of a high-friction road surface treatment.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a", "an" and "the" are intended to include the plural forms as well, unless the context clearly indicates otherwise.

Spatially relative terms, such as "under", "below", "lower", "over", "upper" and the like, may be used herein for ease of description to describe one element or feature's relationship to another when the apparatus is right side up.

The terms "first", "second", and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Terms such as "at least one of A and B" should be understood to mean "only A, only B, or both A and B." The same construction should be applied to longer list (e.g., "at least one of A, B, and C").

The term "consisting essentially of" means that, in addition to the recited elements, what is claimed may also contain other elements (steps, structures, ingredients, components, etc.) that do not adversely affect the operability of what is claimed for its intended purpose as stated in this disclosure. Importantly, this term excludes such other elements that adversely affect the operability of what is claimed for its intended purpose as stated in this disclosure, even if such other elements might enhance the operability of what is claimed for some other purpose.

In some places reference is made to standard methods, such as but not limited to methods of measurement. It is to be understood that such standards are revised from time to time, and unless explicitly stated otherwise reference to such standard in this disclosure must be interpreted to refer to the most recent published standard as of the time of filing.

B. High Friction Road Patch

FIG. 1 is a perspective view of application of a resin base of a high-friction road surface treatment. In the view of FIG. 1, a user 2 is applying a High Friction Surface Treatment (HFST) resin 4 to a road surface 6 using a hand-operated broom 10. HFST is a safety enhancement intended for large pavement surface areas (e.g., thousands of square feet) that intentionally increases surface friction. However, the portion of the road must be closed for a period of hours while resin and aggregate are installed and allowed to cure, leading to temporary closure of large road sections.

The user 2 is applying the resin 4 by hand, using a manual broom to manually spread the resin across surfaces of the road. Note that there may not be equipment employed to ensure an even thickness of the resin other than the user's ability and judgment. This may lead to inherent inconsistency in resin thickness, leaving some areas thinner than others and in some cases, too thin.

The resin 4 may be mixed using chemicals stored in containers 8. The containers 8 are often placed adjacent to the edge of the roadway. The containers 8 may contain various substances or chemicals present in HSFT, including, for example: epoxy resin, bitumen extended epoxy resin, polyester resin, polyurethane resin, acrylic resin, or methyl methacrylate, although other substances are possible. In some instances, the resin 4 may be premixed and stored in a container 8.

Note that road surface 6 must be completely dry in order to properly install the HSFT resin 4. This requires application during a definite and potentially short installation window, and can require reapplication of the resin 4 if the surface becomes wet during the application process. In addition, large amounts of material (resin 4, aggregate 12), must be transported to the application site and applied, making the use of HSFT cost-prohibitive. Because of these logistical issues, cost per square foot/yard increases significantly for smaller areas.

Figure 2:
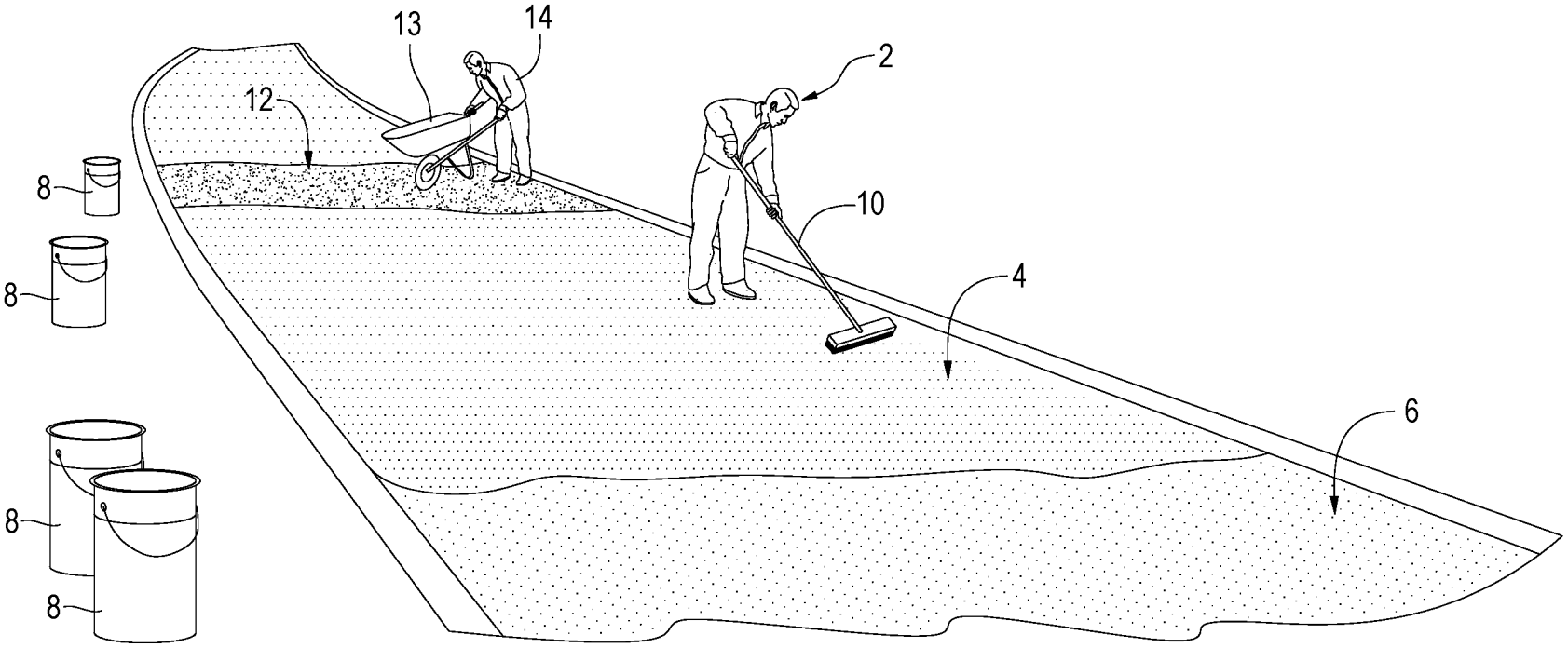
FIG. 2 (Prior Art)
FIG. 2 is a perspective view of application of a resin base and spreading of aggregate of a high-friction road surface treatment.

FIG. 2 is a perspective view of application of a resin base and spreading of aggregate of a high-friction road surface treatment. After the resin 4 is installed or applied, aggregate 12 may be applied over the resin 4. The aggregate 12 contains high-friction particles and grit, which typically includes 6×16 calcined bauxite. The aggregate 12 is applied at a heavy rate, including in some instances, as depicted using a wheelbarrow 13 operated by a user 14. This results in uneven application of the aggregate 12 and in excess aggregate 12 being applied over the resin 4. Such excess aggregate 12 must be removed manually, such as by brooming off the excess onto a shoulder of the road by a user 2 using a broom 10.

Figure 3:
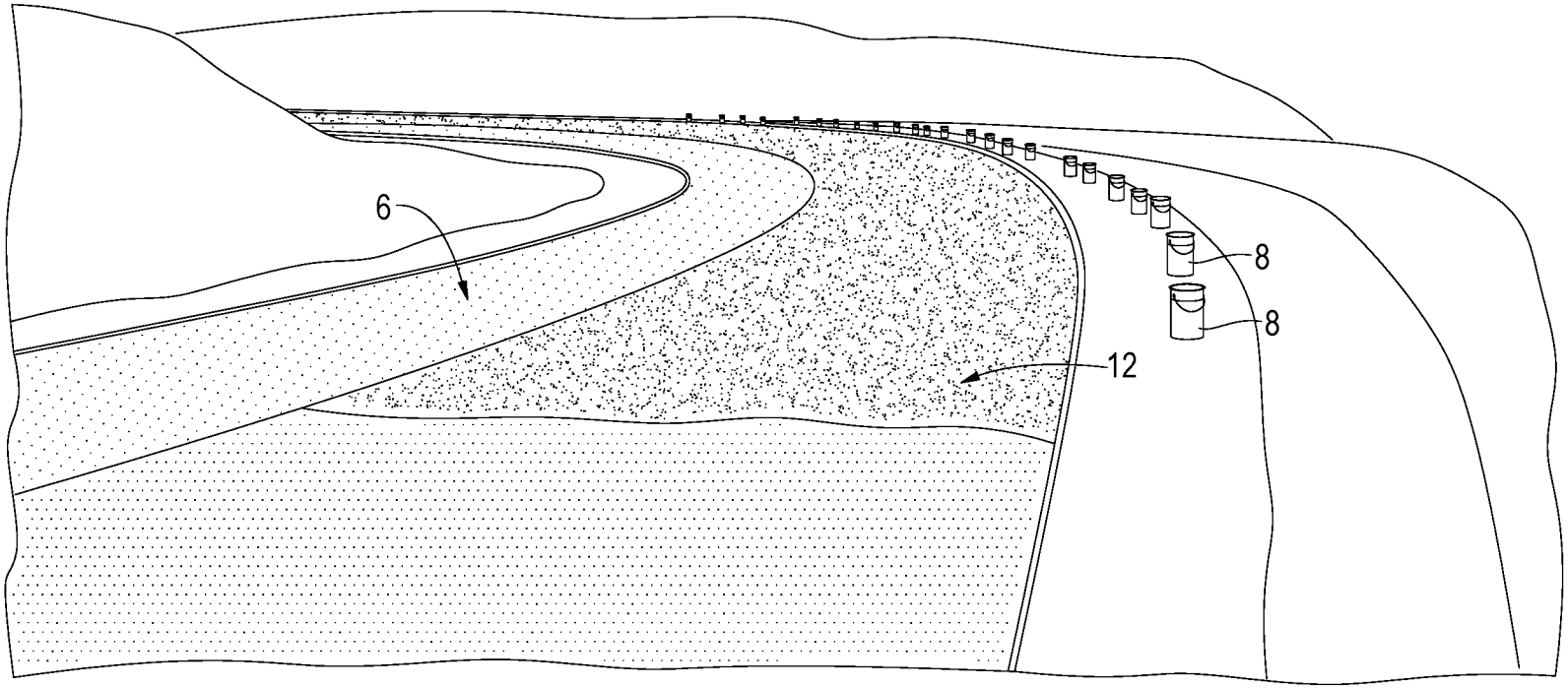
FIG. 3 (Prior Art)
FIG. 3 is a perspective view of applied aggregate spread over a resin base of a high-friction road surface treatment.
Figure 4:
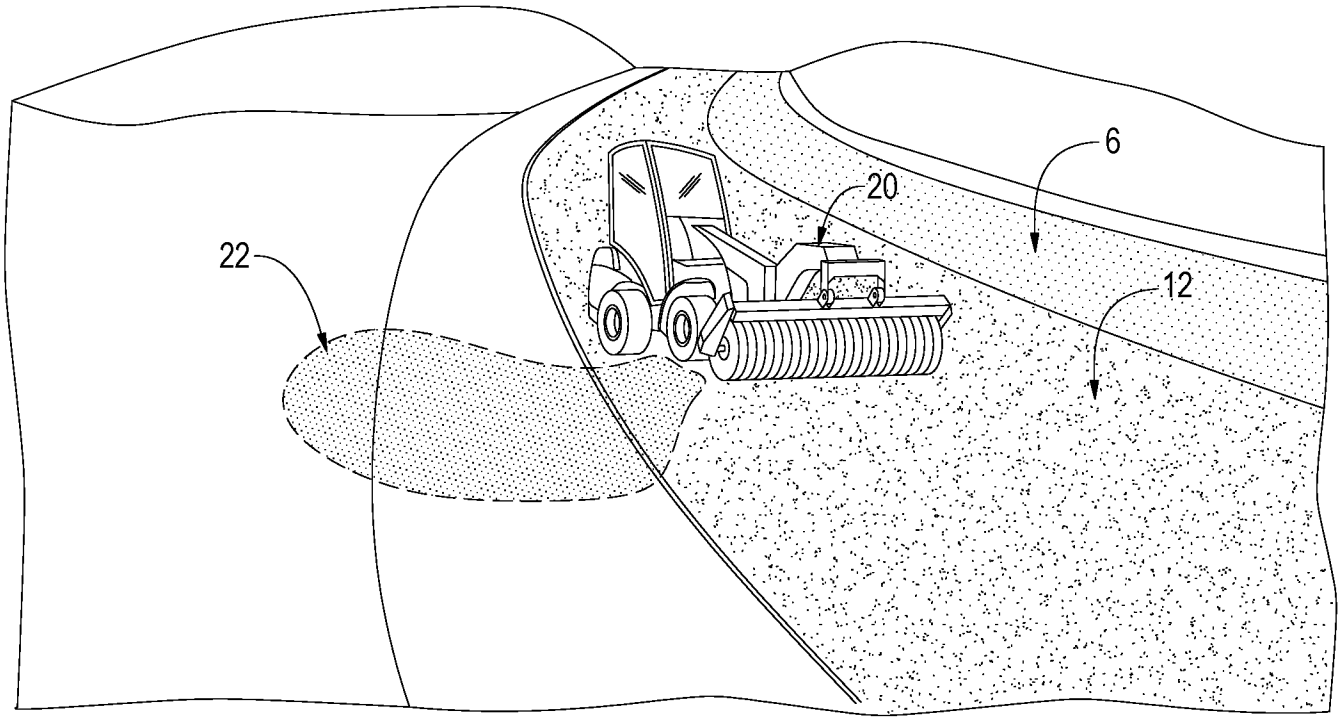
FIG. 4 (Prior Art)
FIG. 4 is a perspective view of removal of excess aggregate following resin curing of a high-friction road surface treatment.

FIG. 3 is a perspective view of applied aggregate spread over a resin base of a high-friction road surface treatment, and FIG. 4 is a perspective view of removal of excess aggregate following resin curing of a high-friction road surface treatment. After the aggregate 12 is applied to the resin 4, the aggregate/resin combination is allowed to cure overnight. A mechanical sweeper 20 is then used to remove excess aggregate, which may be swept into a container. Some particles 22 maybe ejected into the environment adjacent to the road 6. This results in wasted excess aggregate 12. In addition, the road 6 remains closed throughout the process up to this point.

Figure 5:
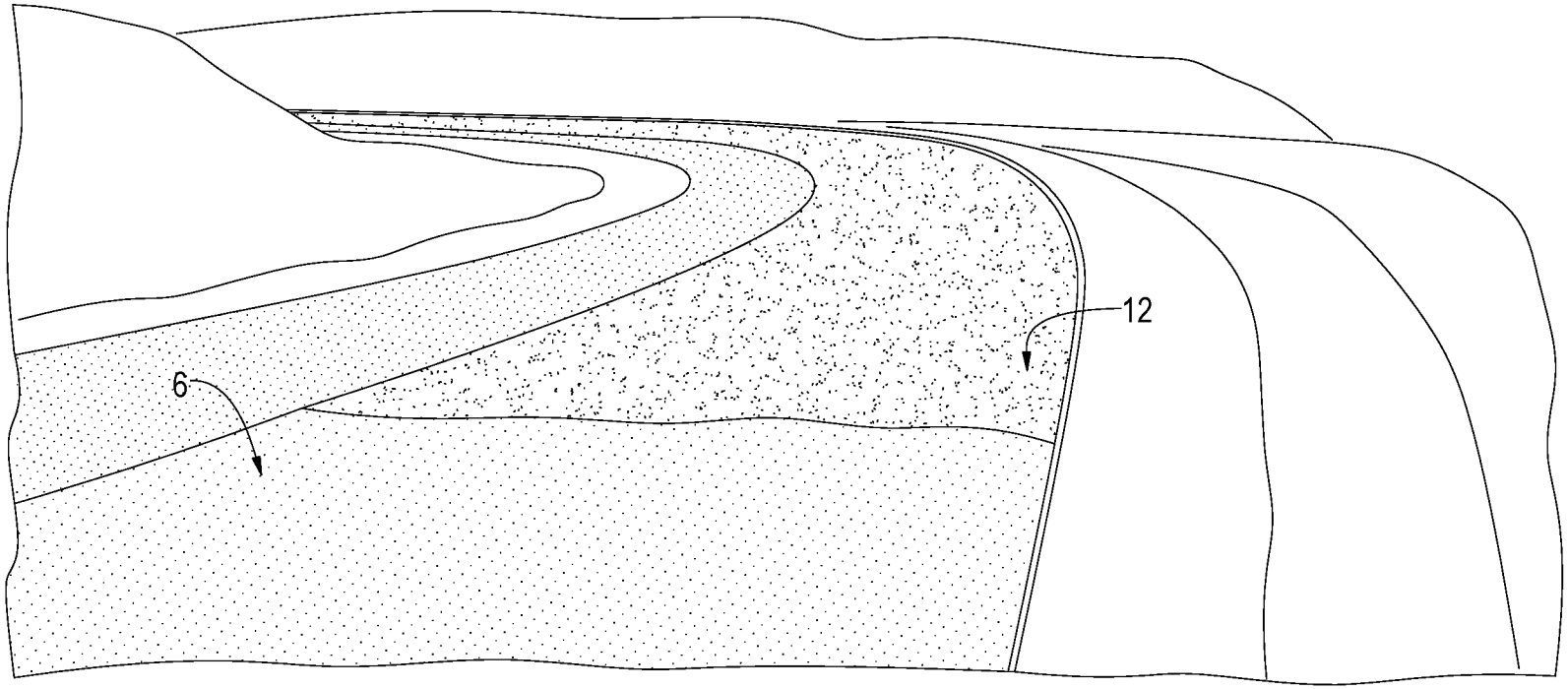
FIG. 5 (Prior Art)
FIG. 5 is a perspective view of a high-friction road surface treatment.
Figure 6:
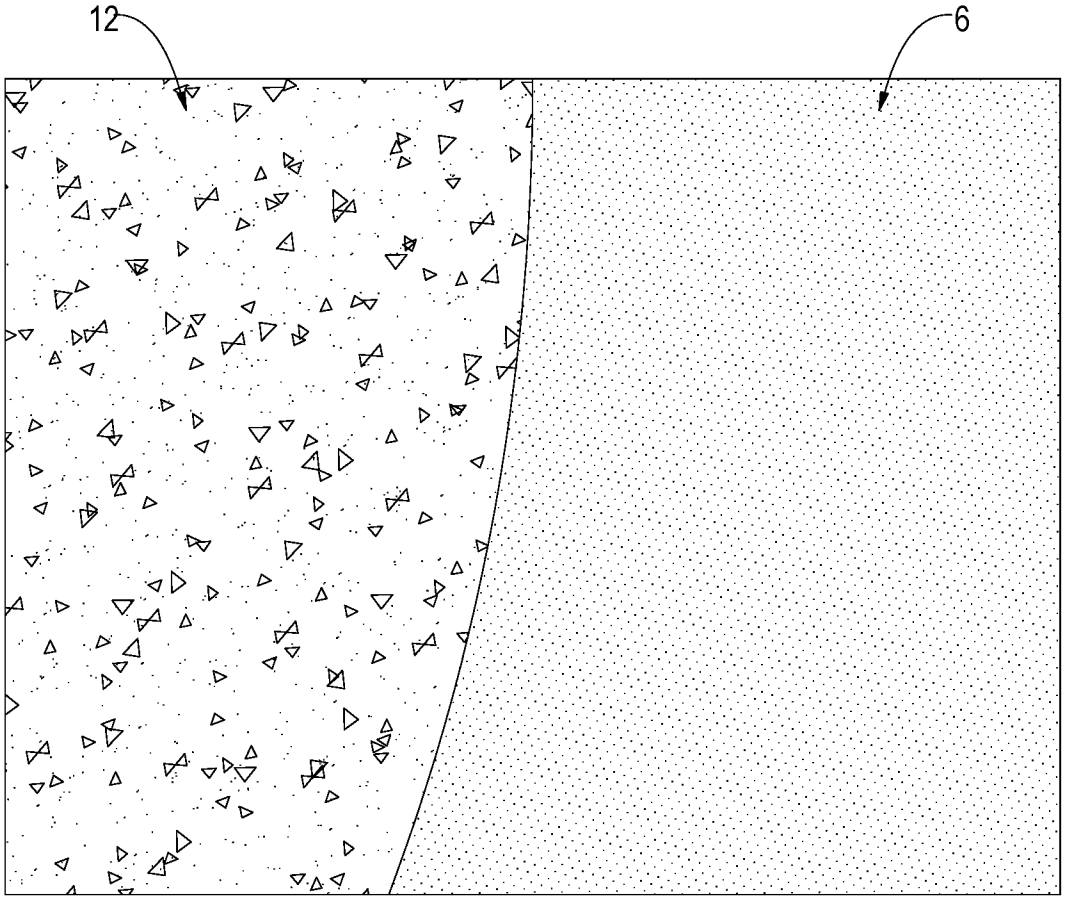
FIG. 6 (Prior Art)
FIG. 6 is a detail view of a high-friction road surface treatment adjacent to an asphalt road surface.

FIG. 5 is a perspective view of a high-friction road surface treatment and FIG. 6 is a detail view of a high-friction road surface treatment adjacent to an asphalt road surface. Following curing of the aggregate 12 and resin 4 and sweeping away of excess aggregate 12, the road section may be opened for traffic. When the HSFT is originally installed, aggregate 12 is present in sufficient density and covers sufficient area to improve friction of the road surface 6. This is illustrated in FIG. 6, surfaces of the road 6 and HSFT aggregate 12 are positioned side-by-side for comparison. The aggregate 12 has a larger and more angular particle size than the road surface 6, which has been smoothed by wear from traffic.

Figure 7:
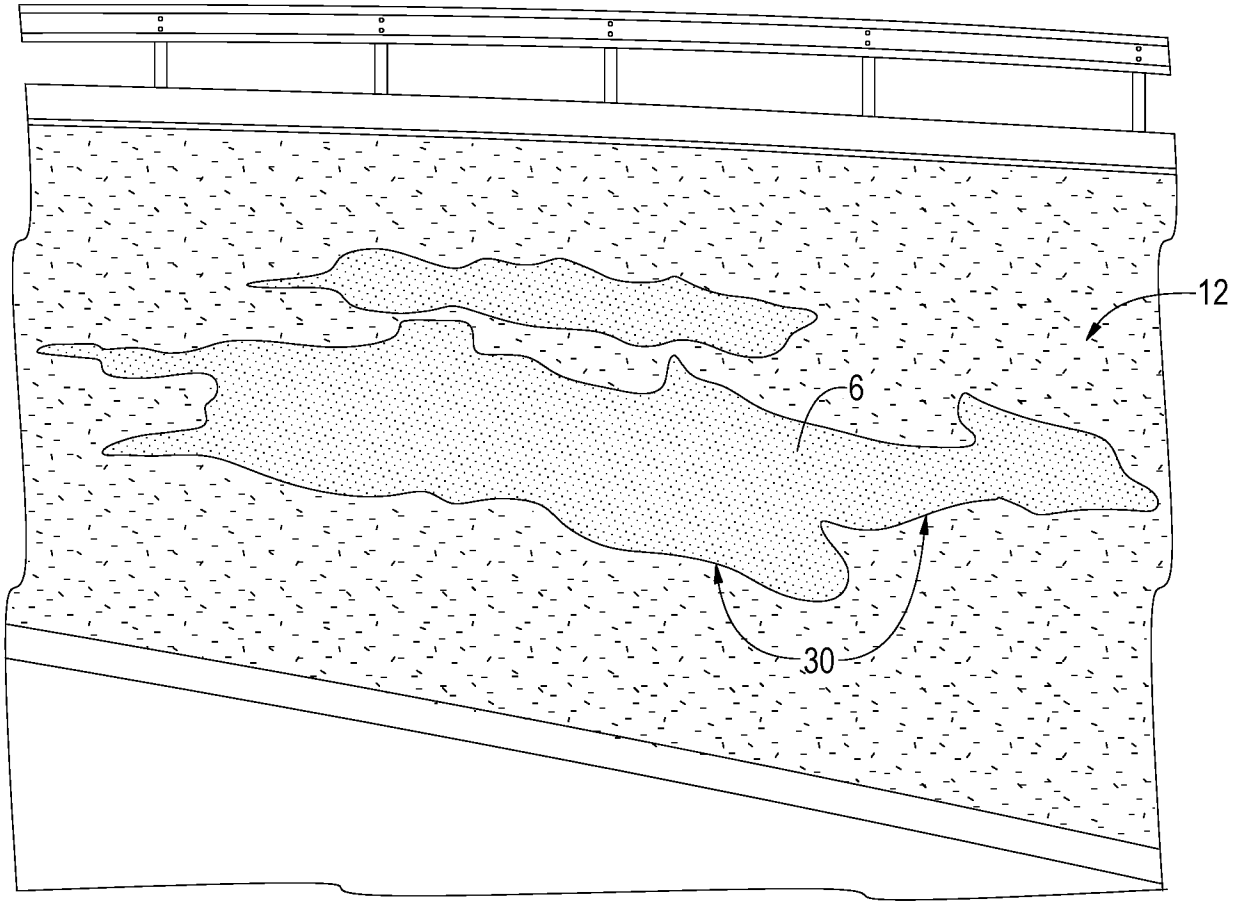
FIG. 7 (Prior Art)
FIG. 7 is a perspective view of a high-friction road surface treatment with portions debonded from the road surface.

FIG. 7 is a perspective view of a high-friction road surface treatment with portions debonded from the road surface. As noted previously, a primary drawback of HSFT is debonding that occurs over time. This can result from wear caused by traffic passing over the road 6, but is frequently caused by introduction of moisture to the HSFT. The HSFT may be exposed to various sources of moisture, including rainwater, humidity, or other moisture sources for extended periods of time. Because the HSFT is not waterproof or water resistant, moisture may be introduced to the interfaces of the HSFT, including between aggregate 12 and resin 4, and even to the interface between resin 4 and road surface 6. This can cause bonds between the aggregate 12 and resin 4 and resin 4 and road surface 6 to fail ("debond"), resulting in loss of HSFT material in large areas 30. This requires reapplication of the HSFT. Debonding also can be caused by age hardening of the HFST, in which the HSFT resin hardens over time and becomes brittle, breaking away under wear from traffic.

Figure 8:
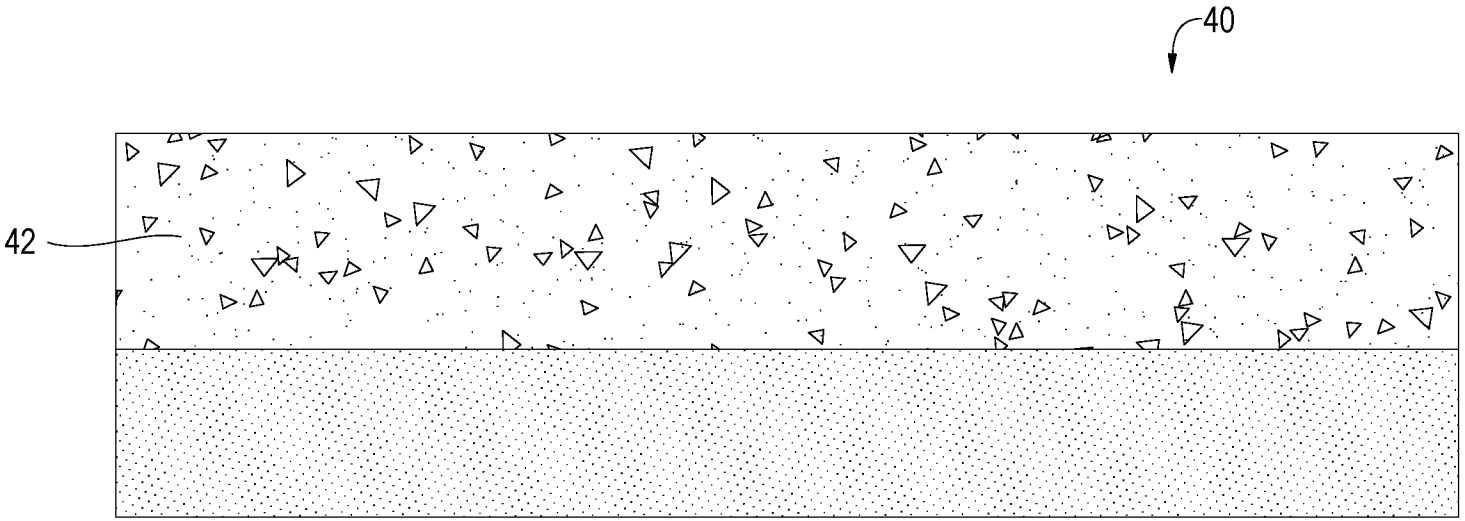
FIG. 8 (Prior Art)
FIG. 8 is a detail view of aggregate of an asphalt road pothole patch.
Figure 9:
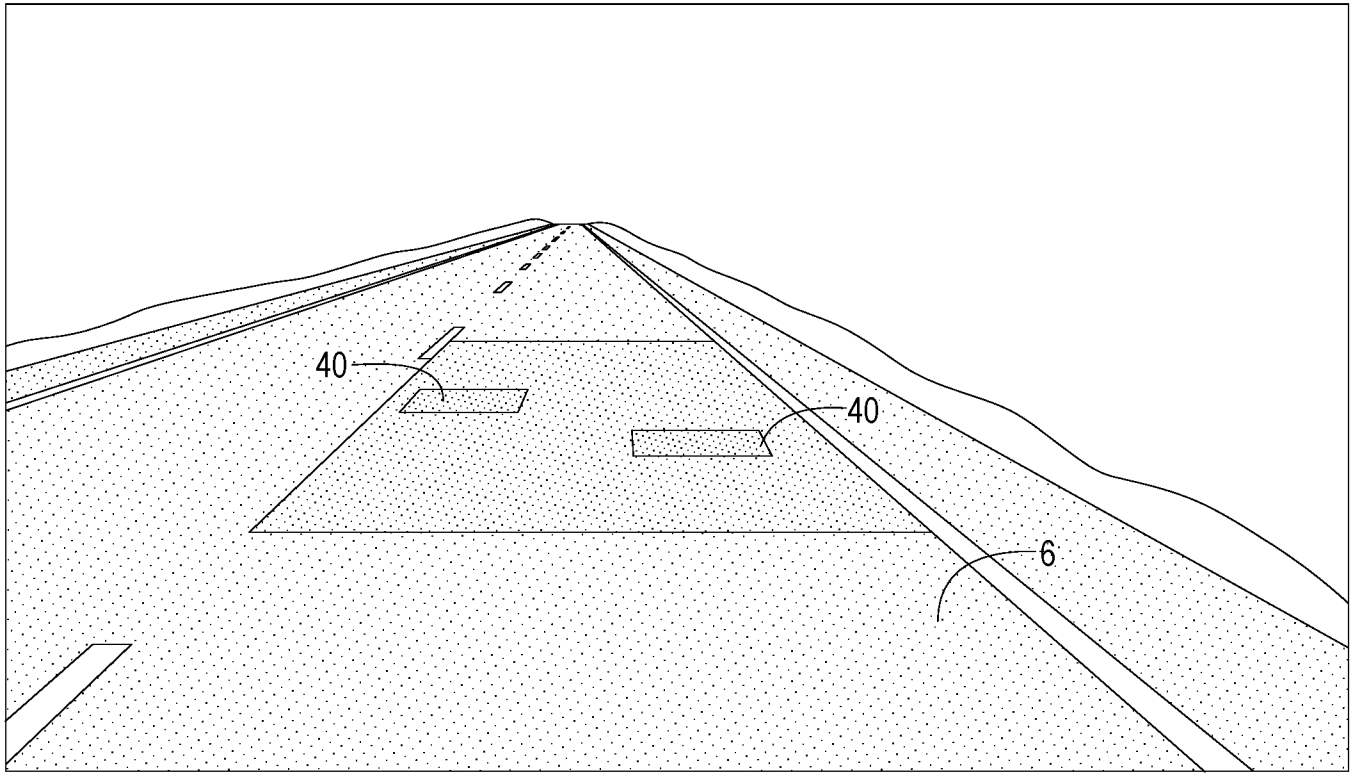
FIG. 9 (Prior Art)
FIG. 9 is a perspective view of an asphalt road pothole patch applied to a road.
Figure 10:
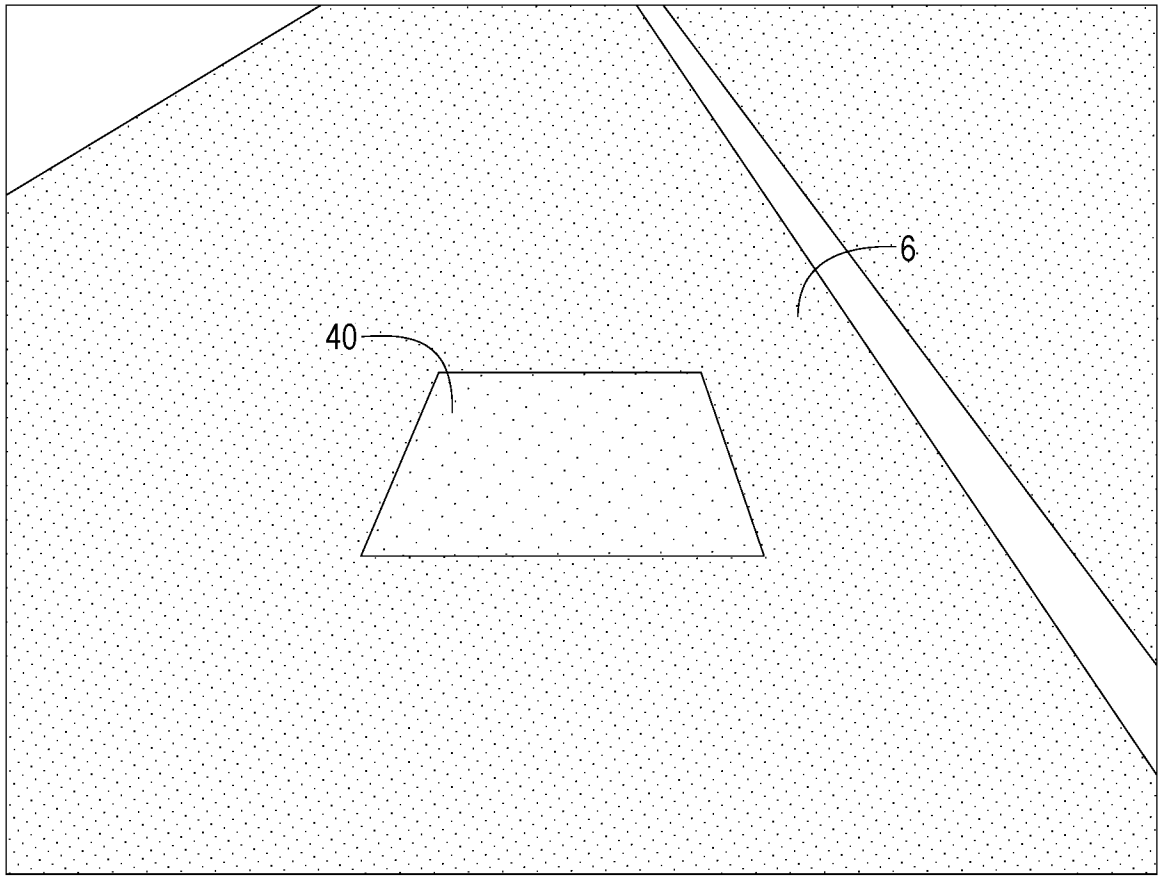
FIG. 10 (Prior Art)
FIG. 10 is a perspective view of an asphalt road pothole patch.

FIG. 8 is a detail view of aggregate of an asphalt road pothole patch, FIG. 9 is a perspective view of an asphalt road pothole patch applied to a road, and FIG. 10 is a perspective view of an asphalt road pothole patch. The pothole patch 40 comprises a waterproof surface seal capable of reducing or preventing moisture intrusion in small pothole repairs (e.g., less than ten square feet). The patch 40 can comprise asphalt, one or more additional materials, or various combinations thereof. The pothole patch 40 can be applied as an overlay to the road 6 and will permanently bond with the road surface. Because the pothole patch 40 is made with a waterproof or water-resistant material, debonding is less common or nonexistent than with HSFT. However, unlike HSFT, the patch 40 comprises aggregate 42 that specifically does not increase surface friction. Additional aspects of the pothole patch 40 and further aspects of some embodiments of a pothole patch 40 are described in U.S. Pat. No. 8,534,954 to Geary, filed Mar. 7, 2012 and entitled "Pot Hole Repair Patch and Method of Installation", and U.S. Pat. No. 8,858,115 to Geary, filed Sep. 16, 2013 and entitled "Pot Hole and Utility Cut Repair Overlay and Method of Installation": each of the foregoing is incorporated herein by reference in its entirety.

Figure 11:
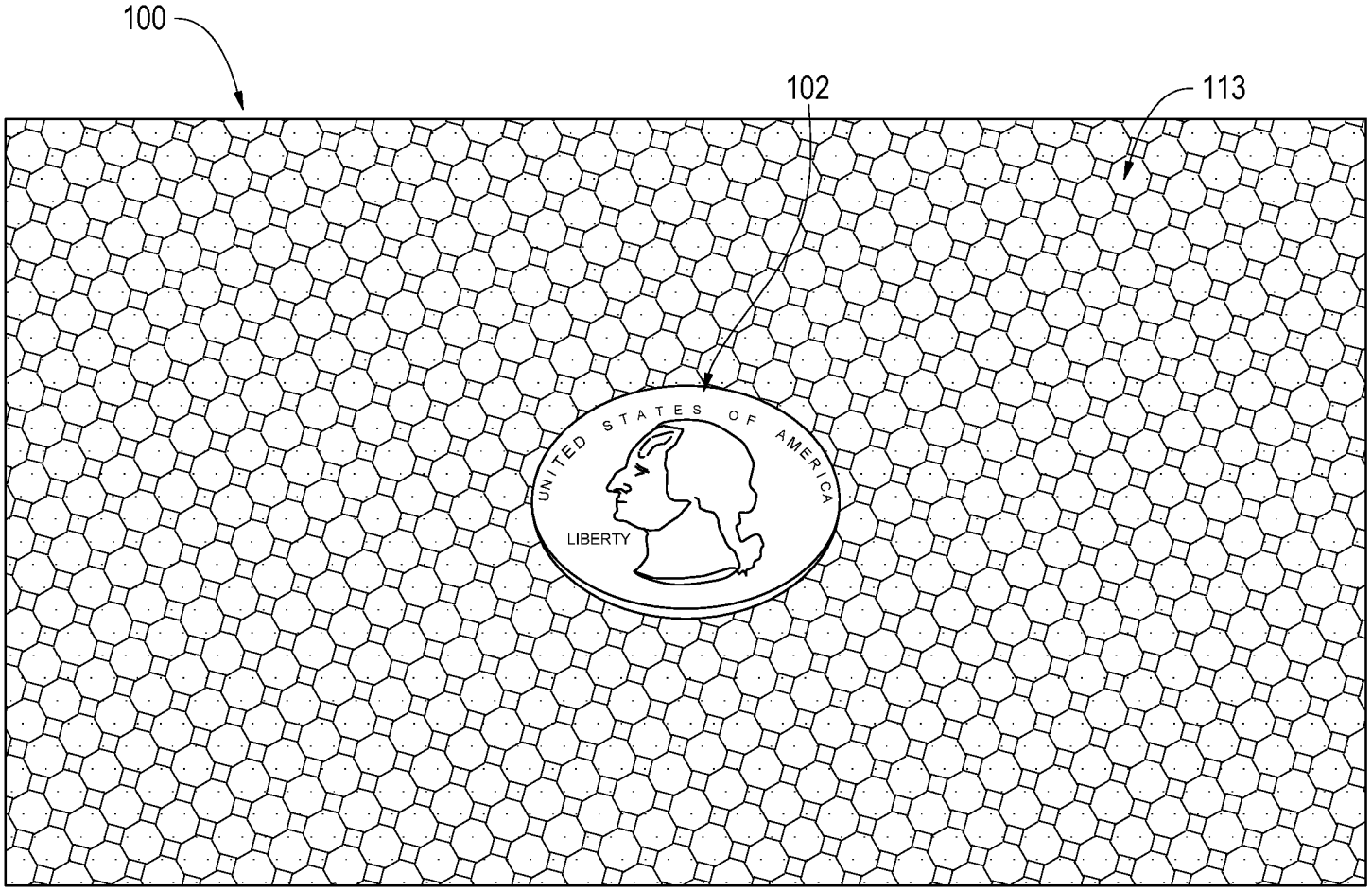
FIG. 11 is a detail view of aggregate of a high-friction road patch in accordance with some embodiments of the present disclosure.

FIG. 11 is a detail view of aggregate 113 of a high-friction road patch 100 (also, "overlay," "laminate," "layer," or similar) in accordance with some embodiments of the present disclosure. In some instances, the high-friction road patch 100 may be referred to herein as a High Friction Surface Seal (HFSS). The HFSS 100 combines aggregate 113 capable of providing sufficient friction between a road surface and vehicle wheel (as described in U.S. Pat. No. 9,739,017, entitled "High friction surface coating and method of making thereof" and filed Nov. 26, 2014, which is incorporated herein by reference in its entirety) with a waterproof, asphalt overlay (as described in U.S. Pat. No. 8,534,954, entitled "Pot hole repair patch and method of installation" and filed Mar. 7, 2012; and U.S. Pat. No. 8,858,115 entitled "Pothole and utility cut repair overlay and method of installation" and filed Sep. 16, 2013, each of which is incorporated herein by reference in its entirety). The resulting product may provide a sufficient Skid Resistance Value in an overlay that is far less susceptible to or incapable of debonding as with HFST.

A coin, in this case, a United States quarter dollar coin 102, is provided for reference.

In some embodiments, the HFSS 100 may provide a safety enhancement product, and may be used for providing a permanent, water-proof or water-resistant improvement over intermediate pavement surface areas (e.g., hundreds of square feet, as opposed to thousands typically covered using HFST), while intentionally increases surface friction (as opposed to having similar friction to the surrounding road surface as in patch 40).

In addition, HFSS enjoys numerous improvements over prior art solutions, including that it: easily may be installed by even a single user quickly, without requiring extended road closures; may be pre-fabricated in size-selectable rolls, reducing waste materials and avoiding iterative experimentation to achieve desired friction/bonding mixture; permanently maintains high-friction over the roadway's life; precludes introduction of moisture to the overlay and road surface, avoids the necessity of time/resource consuming iterative experimentation; and facilitates efficient distribution allowing it to go to market faster, thus more quickly improving roadway safety, reducing accidents and thus saving lives.

Additional description of some embodiments of the present disclosure is included in U.S. Provisional Patent Application No. 63/083,312, entitled "High Friction Surface Membrane (HFSM)" and filed on Sep. 25, 2020 and in U.S. Provisional Application Ser. No. 63/213,070, filed Jun. 21, 2021 and entitled "High-Friction Road Patch," each of which is incorporated herein by reference in its entirety.

Figure 12:
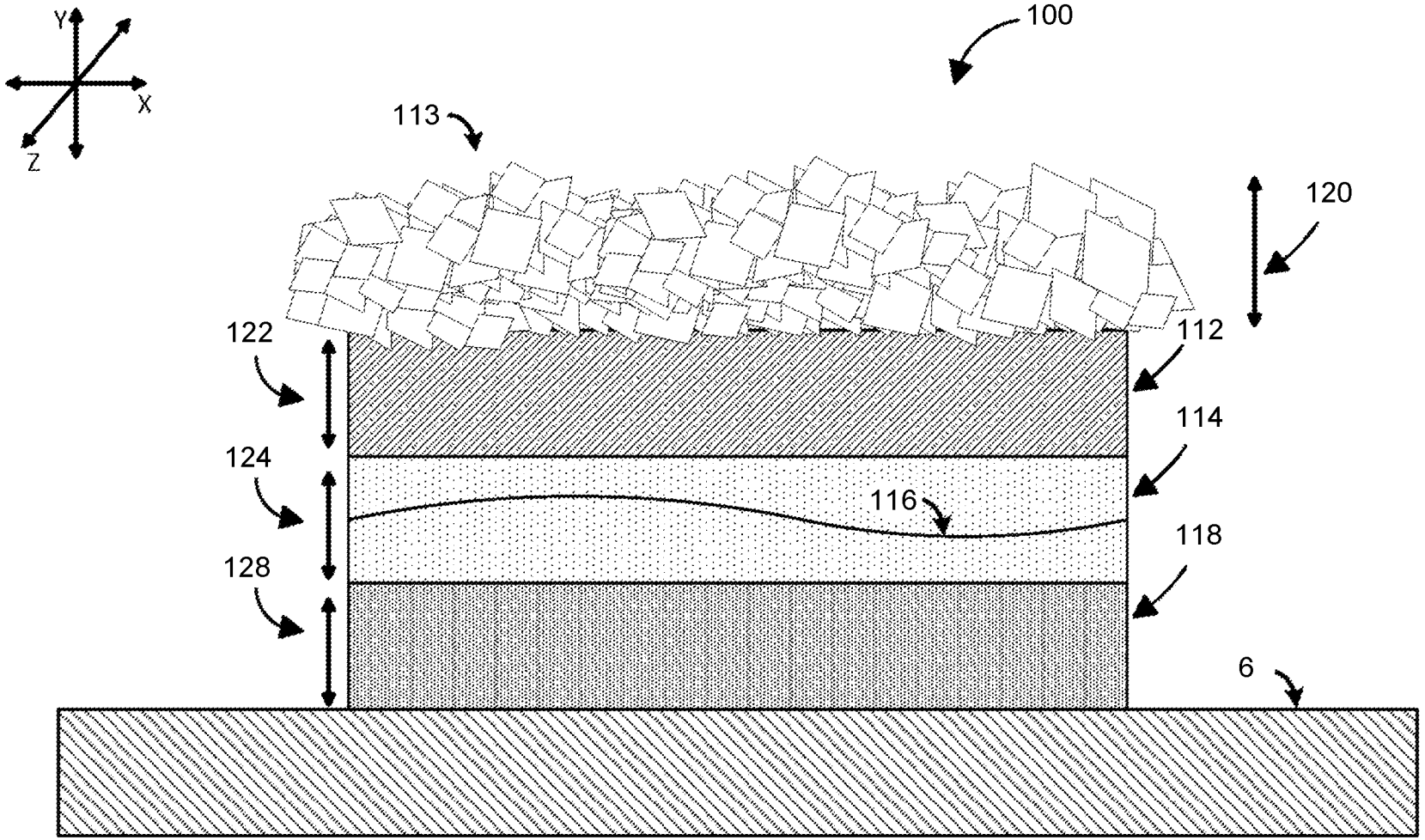
FIG. 12 is a detail view of layers of a high-friction road patch in accordance with some embodiments of the present disclosure.

FIG. 12 is a detail view of layers of a high-friction road patch 100 in accordance with some embodiments of the present disclosure. The HFSS 100 has aggregate 113, a top layer 112, a reinforcement layer 114, and binder layer 118.

In some embodiments, aggregate 113 may be embedded in a top surface of top layer 112 (with the top of the HFSS 100 being an uppermost portion with respect to the positive "Y" axis). An amount of embedment (e.g., distance on the "Y" axis) of particles of aggregate 113 in top layer 112 may vary, but in some embodiments may average approximately between one third and two thirds. This embedment, coupled with permanent installation of the asphalt membrane comprised of layers 112, 114 and 118 may reduce or eliminate debonding, problematic in prior art HFST solutions.

In some embodiments, aggregate 113 may comprise hard, angular, and durable particles for providing a suitable skid resistance value (SRV). Although aggregate 113 is depicted as having a particular particle shape, size, and orientation in FIG. 12, it will be understood that these aspects may vary in some embodiments depending on one or more materials selected for use in aggregate 113, a desired SRV, desired embedment of the aggregate in the top layer 112, or various combinations thereof. As an example, in some embodiments, the aggregate 113 may have a particle size selected to achieve SRV of the HFSS 100 of approximately at least 65 (or a coefficient of friction of 0.65) as measured with a ribbed tire, in wet conditions. Other SRV values for the HFSS 100 may be possible, and aspects of components of the HFSS 100, including aggregate 113 may be selected based on the desired SRV.

As an example, it has been observed that larger stones may result in excessive amounts of stone loss, thus limiting particle size of aggregate 113. When aggregate 113 comprises calcined bauxite, an average particle distribution may be approximately 100 percent passing a 4.75 mm sieve, at least 95 percent passing a 3.36 mm sieve, and no more than 5 percent passing a 1.18 mm sieve (i.e., a "6×16" size), but in some embodiments, the aggregate 113 may comprise approximately 100 percent passing a 4.75 mm sieve, at least 95 percent passing a 3.36 mm sieve, and no more than 5 percent passing a 2.00 mm sieve (i.e., a "6×10 particle size"). In some embodiments, the particle size may be approximately between 4.75 mm and 0.15 mm. Other particle sizes are possible. In some embodiments, particle size of aggregate 113 may be adjusted based on desired SRV, adhesion performance, experimentally derived data, experiential factors, or yet other considerations.

In some embodiments, the aggregate 113 may be essentially the same as aggregate described in U.S. Pat. No. 9,739,017. In some embodiments, the aggregate 113 may comprise calcined bauxite, CAS number 92797-42-7 (e.g., 100% calcined bauxite), a blend of calcined bauxite and other materials, or yet other materials and combinations thereof. The aggregate may comprise materials in other embodiments. The aggregate 113 may have a composition selected to achieve a desired SRV, although in some embodiments, the aggregate 113 may have a composition selected based on other factors such embedment in underlying layers of the HFSS 100, polishing of the aggregate 113, availability of aggregate 113 materials, or yet other factors. In some embodiments, the aggregate 113 may have a thickness 120, which may correspond to a distance between ends of aggregate particles 113 embedded in layer 112 and ends of particles on a top of the HFSS ("top" being the direction of the positive Y-axis). Thickness 120 may be an average thickness across an area of patch 100. Aggregate 113 may have various average thicknesses 120 (e.g., based on particle size, such as 6×10 particle size described below), but in some embodiments thickness 120 may be approximately a single lift of aggregates (i.e., between 4.75 mm and 3.36 mm).

In some embodiments, aspects of aggregate 113 may comply with specifications provided by one or more regulatory bodies or industry associations, for example, specifications set forth by the American Association of State Highway and Transportation Officials (AASHTO) in its Standard Specifications for Transportation Materials and Methods of Sampling and Testing, 33rd Edition, published 2013, and as amended and supplemented from time to time thereafter. In some embodiments, aggregate 113 may have features complying with an AASHTO specification for grit used on HFST surfaces, for example, 100% passing the #4 sieve, at least 95% passing the #6 sieve, and no more than 5% passing the #16 sieve. Other aspects and features of aggregate 113 are possible in other embodiments.

As noted above, HFSS 100 may comprise a membrane composed of top layer 112, reinforcement layer 114 and binder layer 118. With the assurance of high friction, the most important functional performance is bonding of the product to the surface of the roadway. The membrane layers may comprise materials selected to ensure such bonding, including those similar or the same as those described in U.S. Pat. Nos. 8,534,954 and 8,858,115. Textures and shading of the layers 112, 114 and 118 and of road surface 6 are provided for convenience.

These membrane layers 112, 114 and 118 may provide a waterproof or water-resistant aspect to the HFSS 100. In the context of this document, the term "waterproof" may refer to water transmission (or moisture transmission) aspects of the HFSS 100 of essentially zero. Non-zero water transmission of less than approximately $1\times10^{-5}$ cm/second may be referred to as "water-resistance." Water transmission values of the HFSS may range approximately between zero and 1×10−5 cm/second. This waterproof or water resistant feature of HFSS 100 addresses the issues caused by moisture introduction in prior art HSFT solutions.

Top layer 112 may comprise asphalt (CAS number 8052-42-4), but in some embodiments, the top layer 112 may comprise other materials, including modified asphalt, neat asphalt, and asphalt-extended resins, or otherwise. In some embodiments, top layer 112 may comprise other materials. In some embodiments, the top layer 112 may have a thickness 122, which may correspond to a distance between lower ends of aggregate particles 113 (again with respect to the "Y" axis) embedded in layer 112 and an interface between the top layer 112 and reinforcement layer 114. Example thicknesses 122 may include approximately between 1/16 and 1/8 inch; in some embodiments, approximately between 1/32 and 1/16 inch; in some embodiments, approximately between 1/8 and 1/4 inch; in some embodiments, approximately between 1/32 and 1/4 inch. In some embodiments, the top layer 112 may be essentially the same as the top wear layer described in U.S. Pat. Nos. 8,534,954 and 8,858,115, with the aggregate 113 corresponding to the surface frit described in the foregoing patents.

Reinforcement layer 114 may comprise viscous bitumen (CAS number 8052-42-4), or a geosynthetic material, and may be blended with one or more fibrous materials. In some embodiments, the reinforcement layer 114 may comprise other materials, such as fiberglass and elastomeric polymers, as well as various combinations thereof. In some embodiments, reinforcement layer 114 may comprise other materials. In some embodiments, the reinforcement layer 114 may have fibrous material blended or incorporated into it, such as reinforcing material 116, which may have the same or similar features to fibers 16 in U.S. Pat. Nos. 8,534,954 and 8,858,115. The reinforcing material 116 may comprise a mesh screen in some embodiments. In some embodiments, the reinforcement layer 114 may have a thickness 124, which may correspond to a distance (again with respect to the "Y" axis) between an interface between layer 112 and layer 114 and an interface between reinforcement layer 114 and layer 118. Example thicknesses 124 may include approximately between 1/16 and 1/8 inch; in some embodiments, approximately between 1/32 and 1/16 inch; in some embodiments, approximately between 1/8 and 1/4 inch; in some embodiments, approximately between 1/32 and 1/4 inch. In some embodiments, the reinforcement layer 114 may be essentially the same as the reinforcement layer described in U.S. Pat. Nos. 8,534,954 and 8,858,115.

Figure 13:
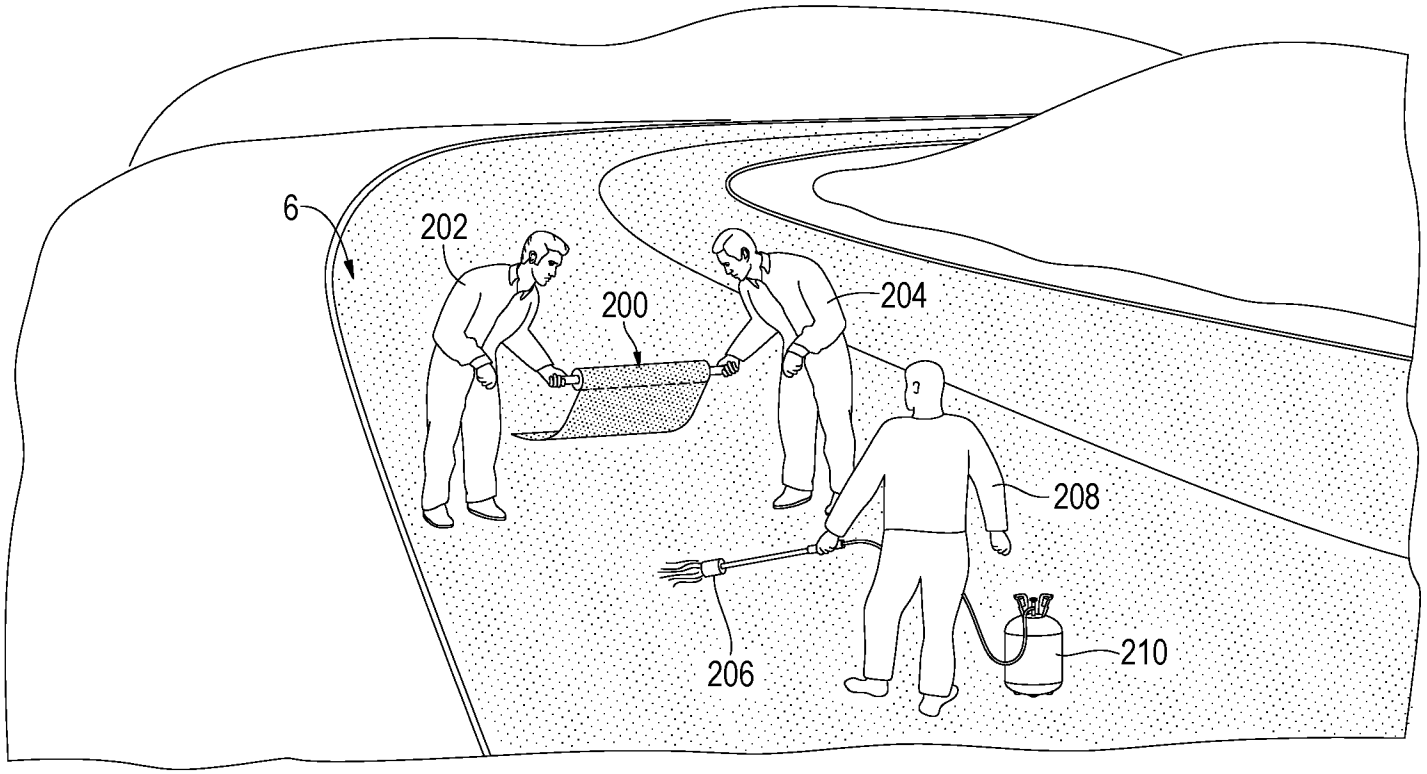
FIG. 13 is a view of users applying a high-friction road patch in accordance with some embodiments of the present disclosure.
Figure 14:
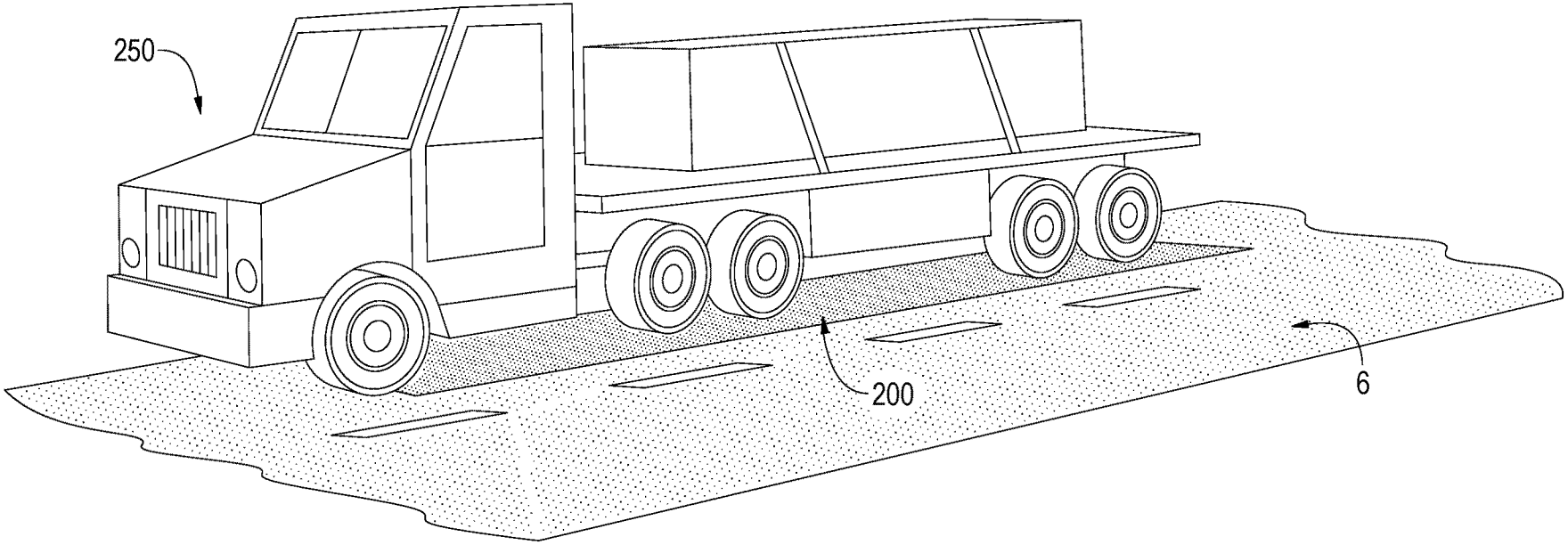
FIG. 14 is a view of a high-friction road patch applied to a road in use with automotive traffic in accordance with some embodiments of the present disclosure.

Binder layer 118 may comprise bitumen (CAS number 9072-35-9), or other materials capable of providing sufficient binding between the road surface 6 and HFSS 100. The binder layer 118 comprises materials ensuring that the HFSS 100 forms an essentially permanent bond with the road surface 6 after installation, such as bitumen, although other materials compatible with pavement surfaces are possible (e.g., modified asphalt, neat asphalt, and asphalt-extended resins), as well as various combinations thereof. In some embodiments, the binder layer 118 may have the same or similar features as the bottom sealant layer in U.S. Pat. Nos. 8,534,954 and 8,858,115. As described in these patents, the binder layer 118 may have a peel-off backing or other preparation for aiding users when installing the HFSS 100. In some embodiments, the reinforcement layer 118 may have a thickness 128, which may correspond to a distance (again with respect to the "Y" axis) between an interface between layer 114 and layer 118 and an interface between layer 118 and road surface 6. Example thicknesses 128 may include approximately between 1/16 and 1/8 inch; in some embodiments, approximately between 1/32 and 1/16 inch; in some embodiments, approximately between 1/8 and 1/4 inch; in some embodiments, approximately between 1/32 and 1/4 inch FIG. 13 is a view of users applying a high-friction road patch 200; FIG. 14 is a view of a high-friction road patch applied to a road in use with automotive traffic; and FIG. 15 is a view of a high-friction road patch applied to a road in use with automotive traffic in accordance with some embodiments of the present disclosure.

Figure 15:
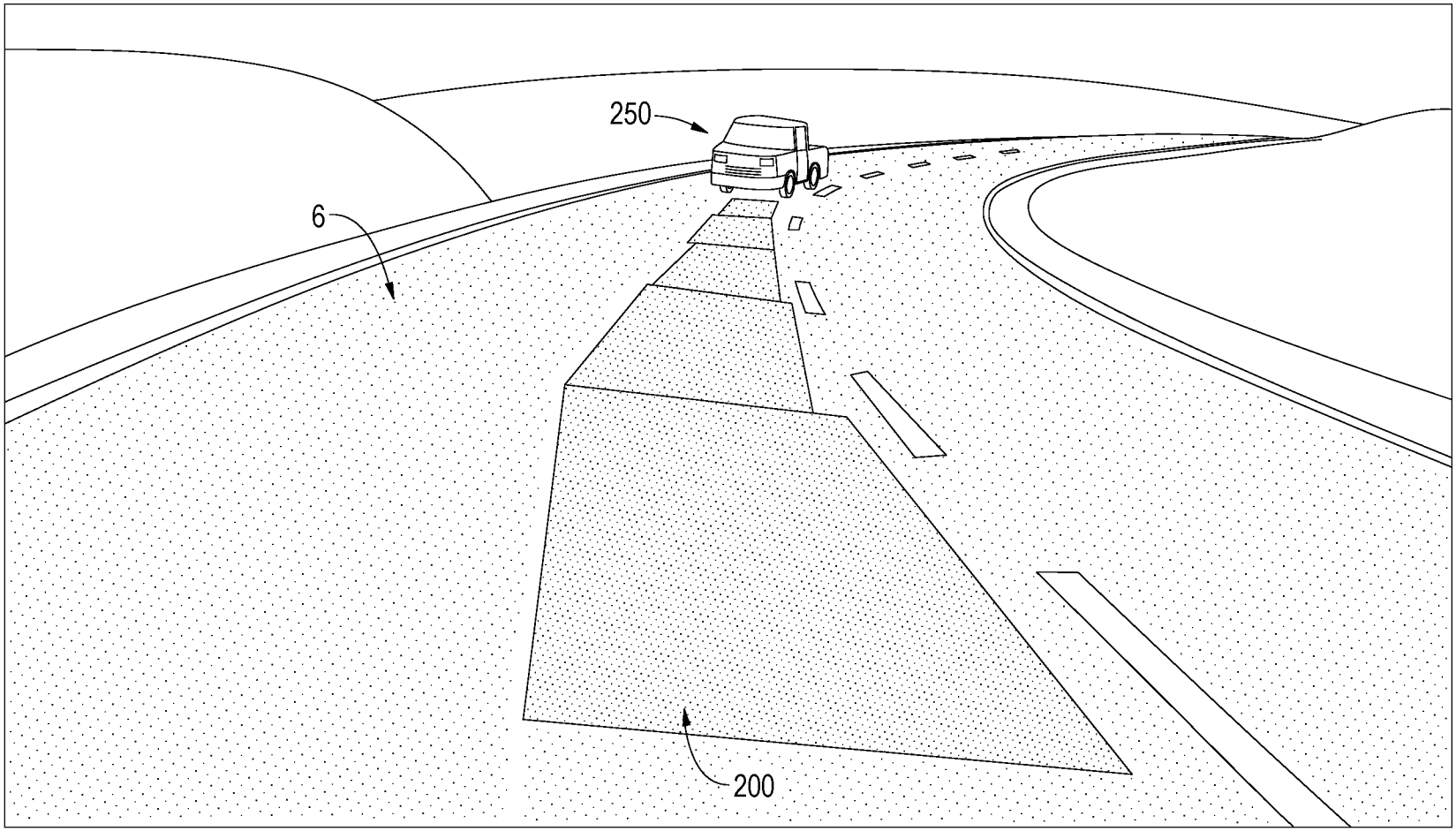
FIG. 15 is a view of a high-friction road patch applied to a road in use with automotive traffic in accordance with some embodiments of the present disclosure.

HFSS 200 of FIG. 13-15 may be the same as HFSS 100 of the other figures, with a new number assigned for convenience.

As noted above, the HFSS 200 can be prepared in rolls, sheets, or other forms suitable for easy transport and storage, and application by users. This may allow a user to select a desired amount of HFSS 100, based on area for which application is desired. In addition, as noted above HFSS 200 is fabricated in advance of its transportation to the work site and application to the road 6. In some embodiments, the HFSS 200 can be prepared in flat sheets and transported on pallets, although the HFSS 200 in FIG. 13 is rolled. HFSS may be rolled into bales or coils in some embodiments.

In FIG. 13, HFSS 200 is being applied to a worn, reduced friction roadway 6 by users 202 and 204 who are unrolling the HFSS 200. In some embodiments, the HFSS 200 can be applied by as few as one user 202, although other numbers of users may apply the HFSS 100 in some embodiments. A user 208 is heating road surface 6 by applying heat from a propane torch 206, fed by propane tank 210. Exemplary desired surface temperatures for the roadway surface 6 include between approximately 75 and 150° F., although other values are possible. An additional propane tank 210 and torch 206 are shown, but only one propane torch and tank are needed for the installation.

Once the pavement surface is sufficiently heated, the HFSS 200 can be rolled out onto the desired installation location. Thereafter, a tamping plate (not specifically shown in the FIGs.) may be used to tamp the HFSS 200 evenly onto the surface of the road 6 to ensure even contact and sufficient adhesion between HFSS 200 and road surface 6. Tamping may be done manually using a manual tamper, or by other techniques (mechanical roller, vibratory plate compactor, etc.). Tamping pressures applied to the HFSS 200 may be between approximately 35 and 100 psi; other pressures are possible in some embodiments.

Once tamping is completed, the roadway 6 may be reopened for use by vehicles 250. The overall installation process for the HFSS 200 requires minutes instead of the hours-long, overnight process of the HSFT prior art solutions.

In this regard, HFSS 200 can be applied in a single application, allowing the roadway to reopen shortly after application (minutes instead of hours or days between application and resumption of traffic). Conversely, installation of HSFT requires longer exposure to road hazards (from adjacent lane that is supporting live traffic); requires a larger crew; involves the necessity of completely dry pavement (which limits installation windows); requires a full lane closure for extended periods of time (e.g., overnight); requires mixing hazardous chemicals at the work site (typically epoxy resin, bitumen extended epoxy resin, polyester resin, polyurethane resin, acrylic resin, or methyl methacrylate); requires additional labor to spread resin; involves wasteful application of expensive high friction particles (typically calcined bauxite) in order to achieve the proper level of embedment; requires use of mechanical power broom to remove excess aggregate; and poses safety risks if used when enough high friction particles have debonded from the age hardened epoxy resin to reduce surface friction to an unsafe level.

C. Clauses

In some embodiments, a layered, pre-fabricated overlay for enhancing road surface friction, comprises a first layer composed of cured bitumen comprising aggregate particles at least partially embedded therein and exposed to contact with automobile tires. The overlay further comprises a second layer disposed beneath said first layer and comprising viscous bitumen. The second layer further comprises a reinforcement component selected from a group consisting of: a) fibrous material disposed within said viscous bitumen; b) a mesh screen encapsulated within said viscous bitumen; and, c) a combination of a) and b). The overlay further comprises a binder layer on an underside of the second layer for bonding the overlay with the road surface.

In some embodiments, the aggregate particles of the overlay may comprise calcined bauxite.

In some embodiments, the aggregate particles of the overlay may comprise a blend comprising calcined bauxite and at least one additional, locally-available material of suitable hardness and angularity.

In some embodiments, aggregate particles of the overlay may comprise a blend of calcined bauxite, at least one additional, locally-available material of suitable hardness and angularity and at least one material provided at a location where the overlay is installed.

In some embodiments, the aggregate particles of the overlay may comprise a blend of materials selected based on a desired coefficient of friction between the overlay and an automobile tire surface when the overlay is installed.

In some embodiments, the at least one material is provided to achieve a desired coefficient of friction.

In some embodiments, a first portion of the overlay is severable from a second portion of the overlay, the first portion applied to the road surface, and the second portion in a rolled position.

In some embodiments, a temperature of at least 75° F. is applied to the road surface to bond the overlay to the road surface.

In some embodiments, a tamping pressure of at least 35 psi is applied to the overlay to bond the overlay to the road surface.

In some embodiments, the aggregate comprises at least 50 100 percent passing the 4.75 mm sieve, at least 95 percent passing the 3.36 mm sieve, and no more than 5 percent passing the 1.18 mm sieve particle size.

In some embodiments, the first layer has an aggregate particle density of at least 27 particles per square inch.

In some embodiments, a surface area of the overlay is 100 square feet or less.

In some embodiments, the binder layer comprises a bituminous adhesive membrane.

In some embodiments, the overlay comprises a moisture transmission rate of less than $1\times10^{-5}$ cm/s.

In some embodiments, a method for enhancing road surface friction, comprises providing a pre-fabricated overlay for application to the road surface. In some embodiments, the overlay comprises a first layer composed of cured bitumen and aggregate particles at least partially embedded therein, wherein the first layer is exposed to contact with automobile tires. In some embodiments, a second layer comprises viscous bitumen disposed beneath the first layer, the second layer further comprising a reinforcement component that is selected from a group consisting of: a) fibrous material disposed within said viscous bitumen; b) a mesh screen encapsulated within said viscous bitumen; and, c) a combination of a) and b); and a binder layer on an underside of the second layer for bonding the overlay with the road surface. In some embodiments, the method further comprises applying the overlay to the road surface.

In some embodiments of the method, the aggregate particles comprise calcined bauxite, and wherein the applying the overlay comprises heating, via a heat source, an area of the road surface for which friction enhancement is desired; positioning a pre-fabricated overlay roll comprising the pre-fabricated overlay onto a surface of the area; and applying a pressure to a surface of the pre-fabricated overlay.

In some embodiments of the method, the aggregate particles comprise a blend comprising calcined bauxite and at least one additional, locally-available material of suitable hardness and angularity.

In some embodiments of the method, the aggregate particles comprise a blend of calcined bauxite, at least one additional, locally-available material of suitable hardness and angularity and at least one material provided at a location where the overlay is installed.

In some embodiments of the method, the aggregate particles comprise a blend of materials selected based on a desired coefficient of friction between the overlay and an automobile tire surface when the overlay is installed.

In some embodiments, a pre-fabricated overlay for enhancing road surface friction comprises a first layer composed of cured bitumen comprising calcined bauxite aggregate particles at least partially embedded therein; a second layer disposed beneath said first layer and comprised of viscous bitumen and a reinforcement component comprising fibrous material; and a binder layer on an underside of the second layer for bonding the overlay with the road surface.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

What is claimed is:

1. A layered, pre-fabricated overlay for enhancing road surface friction, comprising:

a first layer composed of cured bitumen comprising aggregate particles at least partially embedded therein and exposed to contact with automobile tires, wherein the aggregate particles comprise calcined bauxite and wherein the aggregate particles provide increased surface friction above a surface friction of the road surface;

a second layer disposed beneath said first layer and comprising viscous bitumen; said second layer further comprising a reinforcement component selected from a group consisting of: a) fibrous material disposed within said viscous bitumen; b) a mesh screen encapsulated within said viscous bitumen; and c) a combination of a) and b); and a binder layer on an underside of the second layer for bonding the overlay with the road surface, wherein the road surface is heated to a temperature of between 75° F. and 150° F. before the overlay is applied to the road surface.

2. The overlay of claim 1, wherein the binder layer comprises at least one of a) modified asphalt; b) neat asphalt; and c) asphalt-extended resin.

3. The overlay of claim 2, wherein the aggregate particles comprise a blend comprising calcined bauxite and at least one additional, locally-available material.

4. The overlay of claim 3, wherein the aggregate particles comprise a blend of calcined bauxite, at least one additional, locally-available material and at least one material provided at a road surface location where the overlay is installed.

5. The overlay of claim 3, wherein the aggregate particles comprise a blend of materials selected based on a selected coefficient of friction between the overlay and an automobile tire surface when the overlay is installed.

6. The overlay of claim 3, wherein the at least one additional, locally-available material is provided to achieve a selected coefficient of friction.

7. The overlay of claim 1, wherein a first portion of the overlay is severable from a second portion of the overlay, the first portion applied to the road surface, and the second portion in a rolled position.

8. The overlay of claim 1, wherein heat applied to the road surface is applied by a torch.

9. The overlay of claim 1, wherein a tamping pressure of at least 35 psi is applied to the overlay to bond the overlay to the road surface.

10. The overlay of claim 1, wherein the aggregate comprises at least 50 100 percent passing the 4.75 mm sieve, at least 95 percent passing the 3.36 mm sieve, and no more than 5 percent passing the 1.18 mm sieve particle size.

11. The overlay of claim 2, wherein the first layer has an aggregate particle density of at least 27 particles per square inch.

12. The overlay of claim 1, wherein a surface area of the overlay is 100 square feet or less.

13. The overlay of claim 1, wherein the binder layer comprises a bituminous adhesive membrane.

14. The overlay of claim 1, wherein the overlay comprises a moisture transmission rate of less than $1\times10^{-5}$ cm/s.

15. A method for enhancing road surface friction, comprising:

providing a pre-fabricated overlay for application to the road surface, wherein the overlay comprises:

a first layer composed of cured bitumen and aggregate particles at least partially embedded therein, wherein the aggregate particles comprise calcined bauxite and wherein the aggregate particles provide increased surface friction above a surface friction of the road surface, and wherein the first layer is exposed to contact with automobile tires;

a second layer comprising viscous bitumen disposed beneath the first layer, the second layer further comprising a reinforcement component that is selected from a group consisting of: a) fibrous material disposed within said viscous bitumen; b) a mesh screen encapsulated within said viscous bitumen; and, c) a combination of a) and b); and a binder layer on an underside of the second layer for bonding the overlay with the road surface; and applying the overlay to the road surface, wherein the road surface is heated to a temperature of between 75° F. and 150° F. before the overlay is applied to the road surface.

16. The method of claim 15, wherein the binder layer comprises at least one of a) modified asphalt; b) neat asphalt; and c) asphalt-extended resin, and wherein the applying the overlay comprises:

heating, via a heat source, an area of the road surface for which friction enhancement is desired;

positioning a pre-fabricated overlay roll comprising the pre-fabricated overlay onto a surface of the area; and applying a pressure to a surface of the pre-fabricated overlay.

17. The method of claim 15, wherein the aggregate particles comprise a blend comprising calcined bauxite and at least one additional, locally-available material.

18. The method of claim 17, wherein the aggregate particles comprise a blend of calcined bauxite, at least one additional, locally-available material and at least one material provided at a road surface location where the overlay is installed.

19. The method of claim 17, wherein the aggregate particles comprise a blend of materials selected based on a selected coefficient of friction between the overlay and an automobile tire surface when the overlay is installed.

20. A layered, pre-fabricated overlay for enhancing road surface friction, comprising:

a first layer composed of cured bitumen comprising calcined bauxite aggregate particles at least partially embedded therein, wherein the aggregate particles provide increased surface friction above a surface friction of the road surface;

a second layer disposed beneath said first layer and comprised of viscous bitumen and a reinforcement component comprising fibrous material; and a binder layer on an underside of the second layer for bonding the overlay with the road surface wherein the binder layer comprises at least one of a) modified asphalt; b) neat asphalt; and c) asphalt-extended resin, and wherein the road surface is heated to a temperature of between 75° F. and 150° F. before the overlay is applied to the road surface.

* * * * *